US009372056B2

(12) United States Patent
Sullivan et al.

(10) Patent No.: US 9,372,056 B2
(45) **Date of Patent: *Jun. 21, 2016**

(54) BROADHEAD ARROWHEAD WITH TWO-STAGE EXPANSION

(71) Applicants: Brian Sullivan, Alta Loma, CA (US); George S. Eurick, Hanover park, IL (US)

(72) Inventors: Brian Sullivan, Alta Loma, CA (US); George S. Eurick, Hanover park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/564,430

(22) Filed: Dec. 9, 2014

(65) Prior Publication Data

US 2015/0094175 A1 Apr. 2, 2015

Related U.S. Application Data

(63) Continuation-in-part of application No. 13/846,493, filed on Mar. 18, 2013, now Pat. No. 8,905,874.

(51) Int. Cl.
*F42B 6/08* (2006.01)
*F42B 12/34* (2006.01)

(52) U.S. Cl.
CPC .. *F42B 12/34* (2013.01); *F42B 6/08* (2013.01)

(58) Field of Classification Search
CPC ..... F42B 6/08
See application file for complete search history.

(56) References Cited

U.S. PATENT DOCUMENTS 2,212,345 A 9/1938 Krieger
2,540,387 A 2/1951 Butler
2,568,417 A 9/1951 Steinbacher
2,859,970 A 6/1956 Doonan
3,759,519 A 9/1973 Palma
4,099,720 A 7/1978 Zeren
4,166,619 A 9/1979 Bergmann et al.
4,579,348 A 4/1986 Jones
4,615,529 A 10/1986 Vocal
4,642,929 A 2/1987 Franklin
4,973,060 A 11/1990 Herzing
4,998,738 A 3/1991 Puckett
5,046,744 A * 9/1991 Eddy ..... 473/583
5,066,021 A 11/1991 DeLucia
5,082,292 A 1/1992 Puckett et al.
5,083,798 A 1/1992 Massey
5,100,143 A 3/1992 Puckett
5,112,063 A 5/1992 Puckett
5,178,398 A 1/1993 Eddy
D342,303 S 12/1993 Johnson
5,286,035 A 2/1994 Ward
5,458,341 A 10/1995 Forrest
5,472,213 A 12/1995 Dudley
(Continued)

*Primary Examiner* — John Ricci
(74) *Attorney, Agent, or Firm* — Kirk A. Buhler; Buhler & Associates

(57) ABSTRACT

Improvements in a broadhead arrow is disclosed where the arrowhead opens in two stages. This provides a broadhead arrow that can be launched with a traditional or compound bow to allow a hunter to bring down large game in an efficient manner. When an arrow is launched the arrow receives a thrust of energy from the string that launches the arrow. The initial thrust partially opens the arrowhead in a first stage of opening to provide a low fight profile that reduces flight air resistance. Regardless of how hard the initial thrust imparted onto the back of the arrow the blades will not open. Because the initial forward launch has no effect on the final opening of the arrow, only minimal impact forces are needed to completely open the broadhead arrow. The broadhead arrow optionally includes at least one side blade that operate with the main blade.

19 Claims, 8 Drawing Sheets

(56) References Cited

U.S. PATENT DOCUMENTS

| | | | | |
|---|---|---|---|---|
| 5,564,713 | A | 10/1996 | Mizek | |
| 5,803,845 | A | 9/1998 | Anderson | |
| 5,820,498 | A | 10/1998 | Maleski | |
| 5,857,930 | A | 1/1999 | Troncoso | |
| 5,879,252 | A | 3/1999 | Johnson | |
| 5,941,784 | A | 8/1999 | Mizek | |
| 6,200,237 | B1 | 3/2001 | Barrie | |
| 6,258,000 | B1 | 7/2001 | Liechty | |
| 6,270,435 | B1 | 8/2001 | Sodaro | |
| 6,283,880 | B1 | 9/2001 | Barrie | |
| 6,428,434 | B1 | 8/2002 | Liechty | |
| 6,554,727 | B1 | 4/2003 | Armstrong et al. | |
| 6,595,881 | B1 | 7/2003 | Grace, Jr. et al. | |
| 6,626,776 | B2 | 9/2003 | Barrie et al. | |
| 6,669,586 | B2 | 12/2003 | Barrie et al. | |
| 6,830,523 | B1 | 12/2004 | Kuhn | |
| 6,910,979 | B2 | 6/2005 | Barrie et al. | |
| 6,935,976 | B1 | 8/2005 | Grace, Jr. et al. | |
| 7,771,298 | B2 | 8/2010 | Pulkrabek | |
| 8,007,382 | B1 | 8/2011 | Sanford | |
| 8,043,177 | B2 | 10/2011 | Flanagan | |
| 8,105,187 | B1 | 1/2012 | Sanford | |
| 8,182,378 | B1 | 5/2012 | Futtere | |
| 8,197,367 | B2 | 6/2012 | Pulkrabek | |
| 8,210,970 | B1 | 7/2012 | Sanford | |
| 8,210,972 | B2 | 7/2012 | Adams et al. | |
| 8,905,874 | B2 * | 12/2014 | Sullivan et al. | 473/583 |
| 2001/0006916 | A1 | 7/2001 | Liechty, II | |
| 2001/0036876 | A1 | 11/2001 | Barrie et al. | |
| 2002/0065155 | A1 | 5/2002 | Liechty, II | |
| 2002/0098926 | A1 | 7/2002 | Liechty, II | |
| 2003/0004021 | A1 | 1/2003 | Barrie et al. | |
| 2003/0073525 | A1 | 4/2003 | Liechty, II | |
| 2003/0153417 | A1 | 8/2003 | Barrie et al. | |
| 2007/0161438 | A1 | 7/2007 | Fulton | |
| 2008/0102996 | A1 | 5/2008 | Erhard | |
| 2009/0111621 | A1 | 4/2009 | Mizek | |
| 2010/0273588 | A1 | 10/2010 | Pulkrabek | |
| 2012/0220400 | A1 | 8/2012 | Pulkrabek | |

* cited by examiner

BROADHEAD ARROWHEAD WITH TWO-STAGE EXPANSION

CROSS REFERENCE TO RELATED APPLICATIONS

This application is a continuation of application Ser. No. 13/846,493, filed on Mar. 18, 2012 now U.S. Pat. No. 8,905,874 which issued on Dec. 9, 2014 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the invention

This invention relates to improvements in an expanding broadhead arrowhead.

More particularly, the present expanding broadhead arrow has two stages of expansion. The first stage partially expands the arrow head when forward momentum is exhorted onto the arrow, and the second stage fully expands the broadhead arrow when the tip of the arrow makes contact.

2. Description of Related Art Including Information Disclosed Under 37 CFR 1.97 and 1.98.

In archery hunting it is desirable to pierce an animal with a broadhead arrow that can quickly kill the animal and can leave a blood trail that can be tracked to locate the animal. Broadhead arrows create additional drag because of the broad tip of the arrowhead. Broadhead blades which are exposed during flight often result in undesirable steering of the front portion of the arrow, causing the arrow to deviate from a perfect flight path that coincides with a longitudinal axis of the arrow shaft, when loaded or drawn within an archery bow. Reducing the surface area of a broadhead blade, the undesirable steering effects can be reduced. However, by reducing the surface area of a blade, the cutting area within a target or game is also reduced, resulting in a less effective entrance and exit wound.

Conventional blade-opening arrowheads have been designed so that a substantial portion of the blade is hidden within the body of the arrowhead, such as during flight of the arrow. Upon impact, such blades are designed to open and thereby expose a cutting surface or sharp edge of the blade. When the blades of such conventional arrowheads are closed and substantially hidden within the body, the exposed surface area is reduced and thus produces relatively less undesirable steering effects.

When an arrow is sent the shock of sending the arrow can inadvertently open an arrowhead. To maintain the blades in a closed position during flight. Upon impact, such annular retaining rings are designed to sheer or roll back along the opening blades, in order to allow the blades to move to an open position. Quite often, such conventional annular retaining rings are prone to cracking, particularly when the elastomer material dries out. A number of patents and or publications have been made to address these issues. Exemplary examples of patents and or publication that try to address this/these problem(s) are identified and discussed below.

U.S. Pat. No. 5,066,021 issued Nov. 19, 1991 to Paul V. DeLicia discloses an arrow system where impact with the tip of the arrow initializes blade opening. The blades continue to open as the arrow enters into the animal. A glancing blow will not open the blades because they are not sufficiently exposed to make contact with the hide of the animal.

U.S. Pat. No. 5,083,798 issued Jan. 28, 1992 to Douglas J. Massey discloses an expanding broadhead for an arrow. This patent uses an internal slug that moves forward upon impact to open the broadhead. Forward inertial as the arrow is launched has no effect on the inertial slug.

U.S. Pat. No. 8,197,367 issued Jun. 12, 2012 to Larry R. Pulkrabek et al discloses an expandable broadhead with rear deploying blades. The blades are retained in a slot and forces on the ends of the blades slide the blades into an open orientation. With this design a glancing blow will not open the blades because they are not sufficiently exposed to make contact with the hide of the animal to slide one or both of the blades open.

Published U.S. Patent Application number 2003/0153417 that published on Aug. 14, 2003 to Bruce Barrie et al., discloses an expanding broadhead. Upon impact or deceleration of the arrow the blades will translate backward to an exposed condition. While this patent discloses expanding blades, because the initial force required opening the blades can be high to prevent pre-mature opening as the arrow is initially launched.

What is needed is an expanding broadhead arrow where the arrow is set when launched so that it opens easily upon impact of the tip of the arrow. The proposed broadhead arrow with two-stage expansion provides a solution to this problem.

BRIEF SUMMARY OF THE INVENTION

It is an object of the broadhead arrow with two-stage expansion to open in two stages. This provides a broadhead arrow that can be launched with a traditional bow or a compound bow or cross bow to allow a hunter to bring down large game in an efficient manner. The arrow head provides a clean kill that can be easily trailed.

It is an object of the broadhead arrow with two-stage expansion to be set when the arrow is launched. When an arrow is launched the arrow receives a thrust of energy from the string that launches the arrow. This thrust of energy that launches the arrow from a stopped condition can open other broadhead arrows, but in this embodiment the thrust simply sets the broadhead. The initial thrust partially opens the arrowhead in a first stage of opening. Regardless of how hard the initial thrust that is imparted onto the back of the arrow the blades will not open.

It is an object of the broadhead arrow with two-stage expansion to require less force to open the arrow on impact with an object. Because the initial forward launch has no effect on the final opening of the arrow only minimal impact forces are needed to completely open the broadhead arrow. Even a glancing blow can extend the arrowhead from the retracted position to the expanded position without relying upon contact of the blades of the arrowhead to push the arrowhead open.

It is another object of the broadhead arrow with two-stage expansion to have sharpened cutting edges that efficiently open to cut into a game animal. The sharpened edges provide the benefit of reducing the time an animal might suffer and providing a blood trail that can be more easily tracked to locate the game. The sharpened surfaces can be on multiple sides of the broadhead or can be on only one side to encourage the broadhead arrow to turn as it passes through an animal.

It is another object of the broadhead arrow with two-stage expansion to have a low flight profile. The low profile reduces wind drag that can slow the arrow in flight and reduces influences on trajectory that would be effected by an open arrows trajectory. A minimally expanded head further allows the arrowhead to be packed in a smaller area for transportation.

It is still another object of the broadhead arrow with two-stage expansion to optionally include side blades that are controlled to open with the main blades when the main blades are opening. A tab on the main blades lift from a gate in the side blades to allow the side blades to rotate and open to the rear upon impact with a target.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
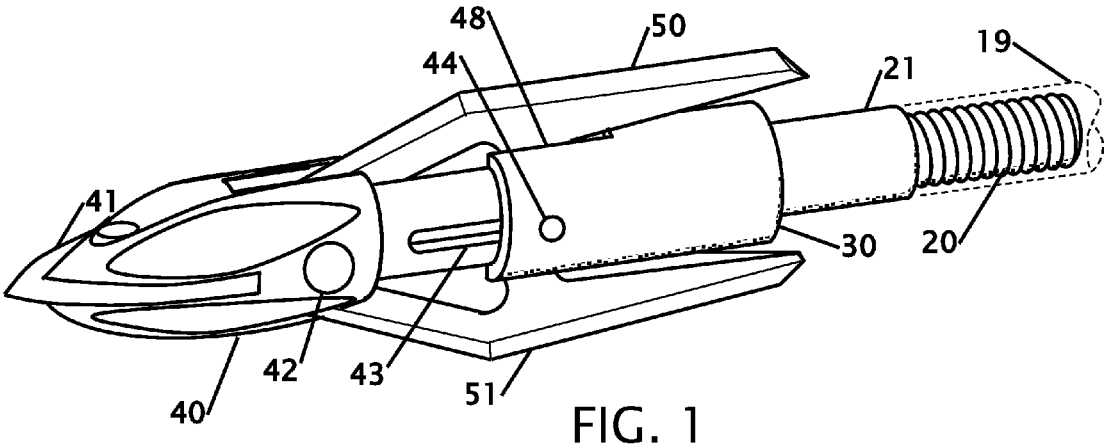
FIG. 1 shows a perspective view of the arrowhead in a retracted orientation.

FIG. 1 shows a perspective view of the arrowhead in a retracted orientation. The arrowhead is shown with a threaded 20 shaft 21 for screwing into the shaft of an arrow 19. Normally the arrowhead is finger tightened to allow the shaft 19 to be unscrewed from the arrowhead thereby allowing the shaft of the arrow to be pulled through a hole without the need to pull the arrowhead through the hole. The blades 50 and 51 are initially retracted or placed into the housing body 30 to create a smaller profile to reduce air resistance and allow the arrow to travel with greater speed and accuracy. The blades 50 and 51 are initially retracted or placed into a 48 recess that is sized to accommodate the width of the blades when the pair of rear deploying blades is oriented toward opposite sides of the housing body 30.

The body of the arrowhead has a front body section 40 with a tip blade 41. In the embodiment shown the tip is shown as a rounded tip with a point. It is also contemplated that the tip area 41 can be fitted with additional cutting surfaces. In the embodiment shown there are two expandable blades 50 and 51. Each blade 50 and 51 is connected to the head with a pivot axle 42 and a guide pin 44. The guide pin 44 is further located within a track 43 that provides linear motion of the guide pin 44 within the arrowhead. The blades 50 and 51 remain in the retracted orientation until the arrow is launched from a bow, compound bow, cross bow or other bolt launching apparatus.

Figure 2:
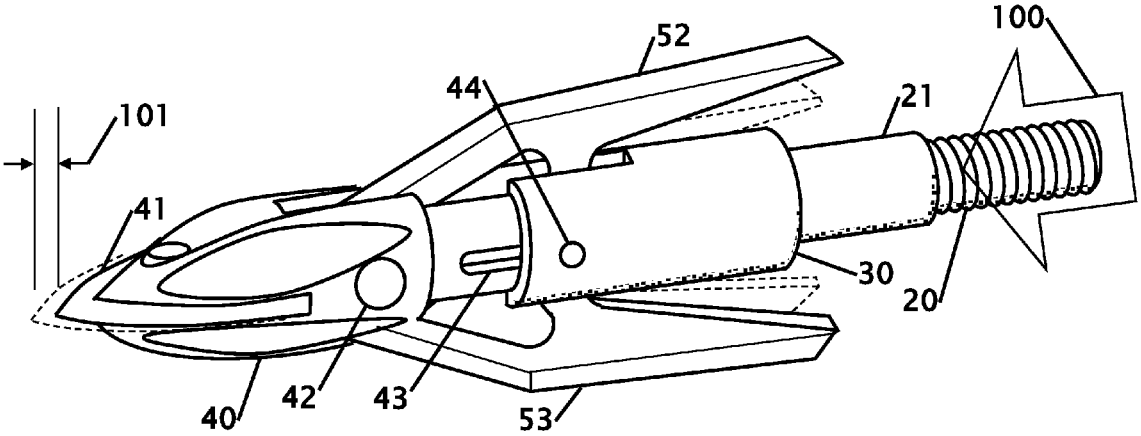
FIG. 2 shows a perspective view of the arrowhead in a set or primed orientation.

FIG. 2 shows a perspective view of the arrowhead in a set or primed orientation. The arrowhead enters this condition when sufficient force 100 is exerted onto the end of the arrow shaft that is transferred 100 to the arrowhead. Because the arrowhead originally has a mass as rest, the initial acceleration or thrust 100 primes the arrowhead. In general, regardless of how much force or acceleration is forced 100 into launching the arrow, the arms 52 and 53 will only extend a limited amount to set the arrowhead. The arms 52 and 53 will pivot on axle 42 and a track within each arm will be guided by the guide pin 44 that moves within track 43. The operation of the track and guide pin 44 is shown and described in more detail with FIGS. 4 to 7. The tip of the arrowhead 40 and 41 will also slightly displace 101. The arrowhead will remain in this primed or set condition as the arrow travels in flight until the tip blade 41 or tip body 40 of the arrowhead makes contact with a surface and then further expands as shown in FIG. 3.

Figure 3:
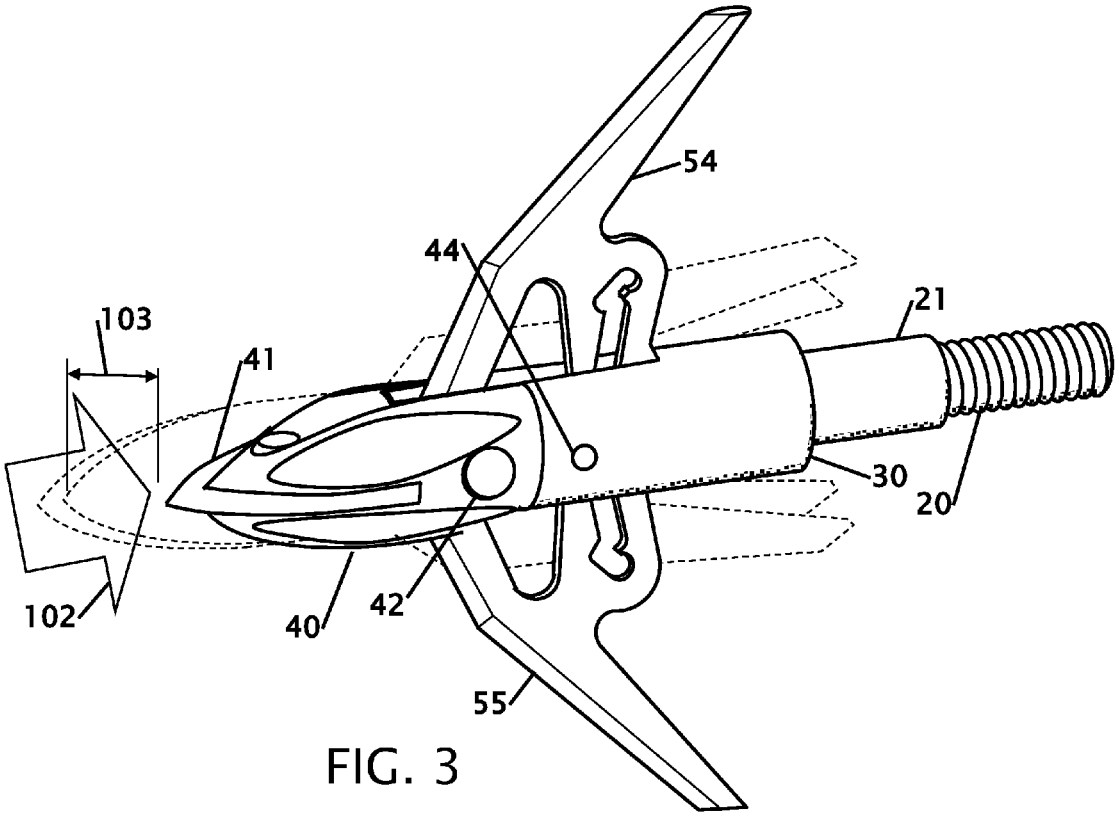
FIG. 3 shows a perspective view of the arrowhead in an open orientation.

FIG. 3 shows a perspective view of the arrowhead in an open orientation. This figure shows phantom lines from the initial and set position for the arms 54 and 55. Contact with the tip blade 41 of the arrowhead moves 102 the head of the arrowhead tip blade 41 to a displaced distance 103 whereby the arms 54 and 55 are fully extended to allow the arrowhead to create maximum harm to the game. In this figure the tip body 40 makes contact with the housing body 30. The arms 54 and 55 pivot from the axle 42 whereby slots within the arms 54 and 55 track on guide pin 44.

Figure 4:
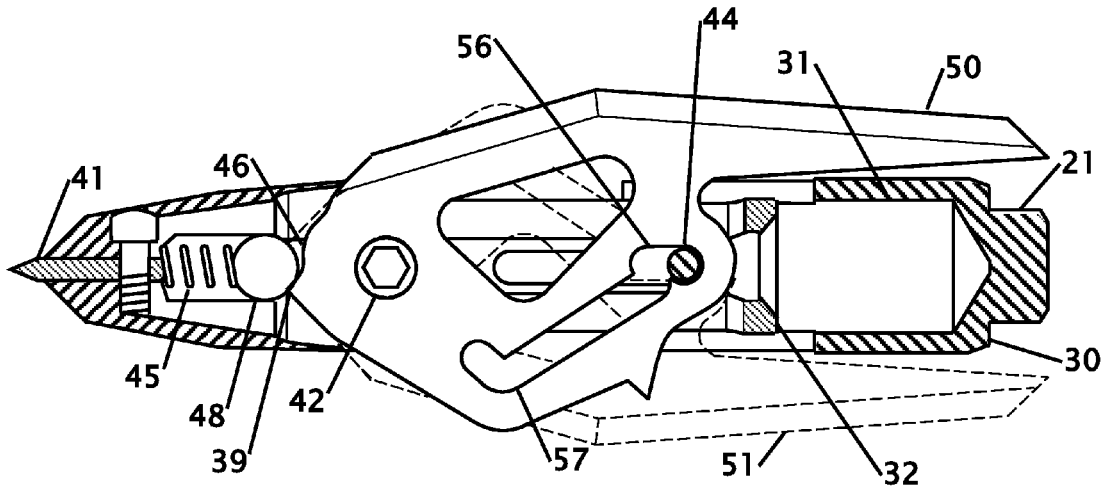
FIG. 4 shows a plan cross-sectional view of the arrowhead in a retracted orientation.
Figure 5:
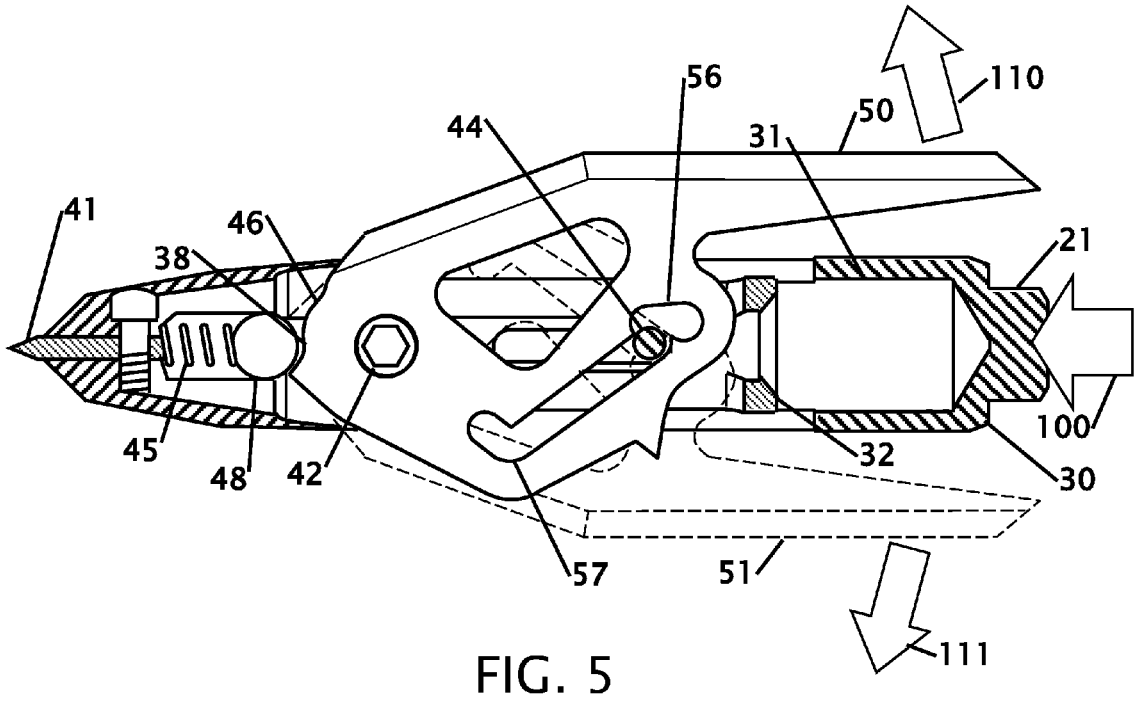
FIG. 5 shows a plan cross-sectional view of the arrowhead in a set or primed orientation.
Figure 6:
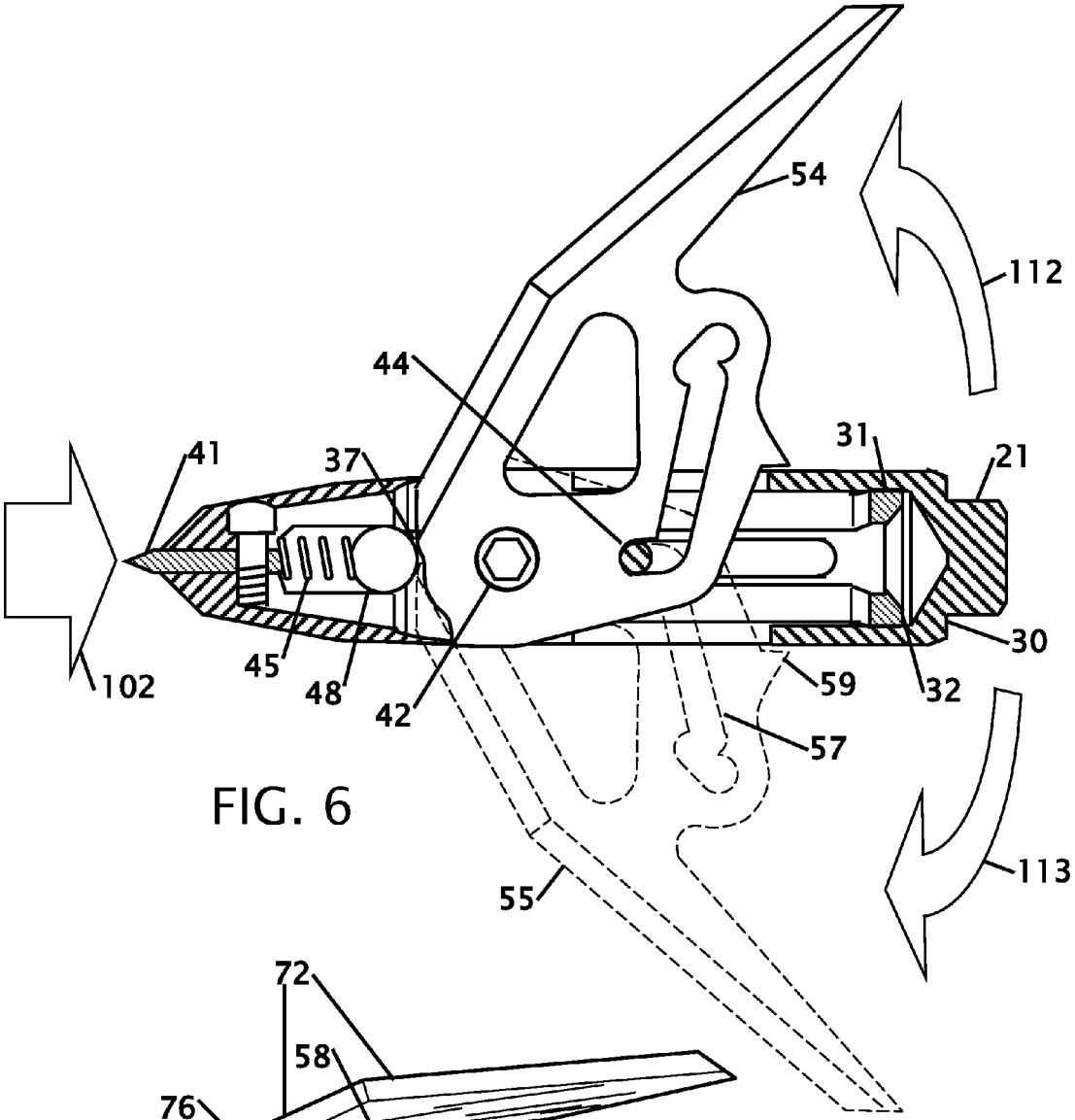
FIG. 6 shows a plan cross-sectional view of the arrowhead in an open orientation.

FIG. 4 shows a plan cross-sectional view of the arrowhead in a retracted orientation, FIG. 5 shows a plan cross-sectional view of the arrowhead in a set or primed orientation and FIG. 6 shows a plan cross-sectional view of the arrowhead in an open orientation. The internal structure shows the arm in the closed condition 50, 51, in FIG. 4, in the primed or set condition 52, 53 in FIG. 5, and in an extended condition 54, 55 in FIG. 6. A compression spring 45 and the guide pin or plunger 44 places force between the inside of the notch 47 and the ball 48 guide ends 46 of the arms. The travel guide end 46 has a tip 39, a flat 38 and a stop 37 positions to force the blade angles and the blade travels through the closed, primed and opened configurations. With the assistance of the ball 48 that is being pushed by the compression spring 45 guide is held in the multiple positions. The compression spring 45 and plunger 44 helps to maintain the arms in distinct set positions. The arms are pivotally secured on axle 42. The pivotal axle 42 moves with the tip 40 and the tip blade 41 of the body.

The arms are further engaged on a guide path 57 that follows on a guide pin 44 that opens the arms in a pre-defined path as identified by the guide path 57 in each arm. Both arms are essentially identical in shape and configuration. They are placed within the arrowhead in a mirror image orientation. The guide pin 44 is connected to a sleeve 31 that provides a linear travel of the piston 32.

In FIG. 4 the guide pin 44 is at the end of the guide path 56. Going to FIG. 5 the guide pin 44 has moved forward within guide path 56 where the arms have slightly opened 110 , 111. This travel is created by launching 100 the arrow. The piston 32 has slightly moved within the cylinder 31 from FIGS. 4 to 5. The front impact 102, from FIG. 6, moves the guide pin 44 along the guide path 57 and into an end of travel stop where the piston 32 is also at the end of travel within the cylinder 31 whereby the arms 54 and 55 become fully extended 112, 113. At this fully extended position, tabs 59 are engaged in the sides of the body 30 to prevent closing as the broadhead arrow travels through an animal, this is provided with added locking reinforcement along with pin 44.

Figure 7:
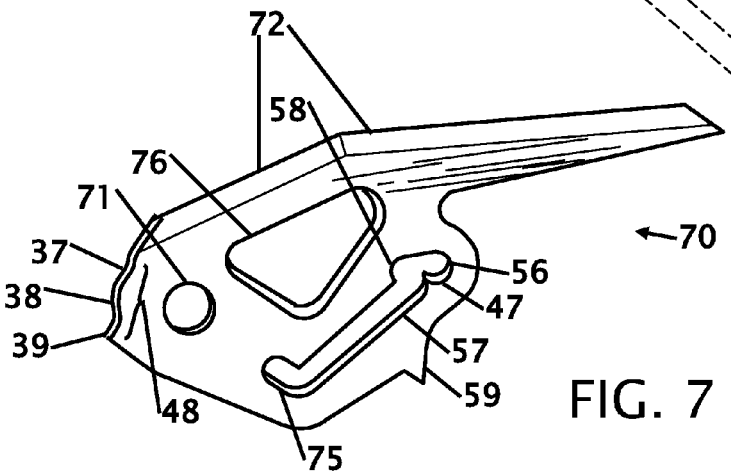
FIG. 7 shows a perspective view of a single blade.

FIG. 7 shows a perspective view of a single blade. The blade and or the arrowhead components are fabricated from a rigid and light weight metal, but other metals and materials are contemplated including but not limited to tool steels; M-2, S-7 & D-2, stainless steels; such as 301, 304, 410, 416, 420, 440A, 440B, 440C, 17-4 PH, 17-7 PH, 13C26, 19C27, G1N4, & other razor blade stainless steels, high speed steel, carbon steels, carbides, titanium alloys, tungsten alloys, tungsten carbides, powdered metal, as well as other metals, ceramics, zirconia ceramics, organic polymers, organic polymer containing materials, plastics, glass, silicone containing compounds, composites, or any other suitable material that a cutting blade or equivalent could be fabricated from, or could be at least in part fabricated.

A hole 71 provides the rotational pivoting of the blade that fits over axle 42. Hole 76 is provided as a lightening feature to reduce the weight of the blade 70. The entire guide path is shown in this view. In the closed position the guide pin 44 initially sits at one end 56 of the guide path in a rest notch 47. Upon launching the arrow the guide pin will travel to stop location 58. Impact of the tip of the arrowhead moves the guide pin 44 along path 57 until the stop at 75 is reached. When the guide pin 44 reaches the end of travel at stop 75 ear 59 also engages on the body of the arrowhead to prevent the blade 70 from closing. Ball guide 48 has a tip 39, a flat 38 and a stop 37. The wing 70 has two cutting surfaces 72 but can have rounded or serrated cutting surfaces.

Figure 8:
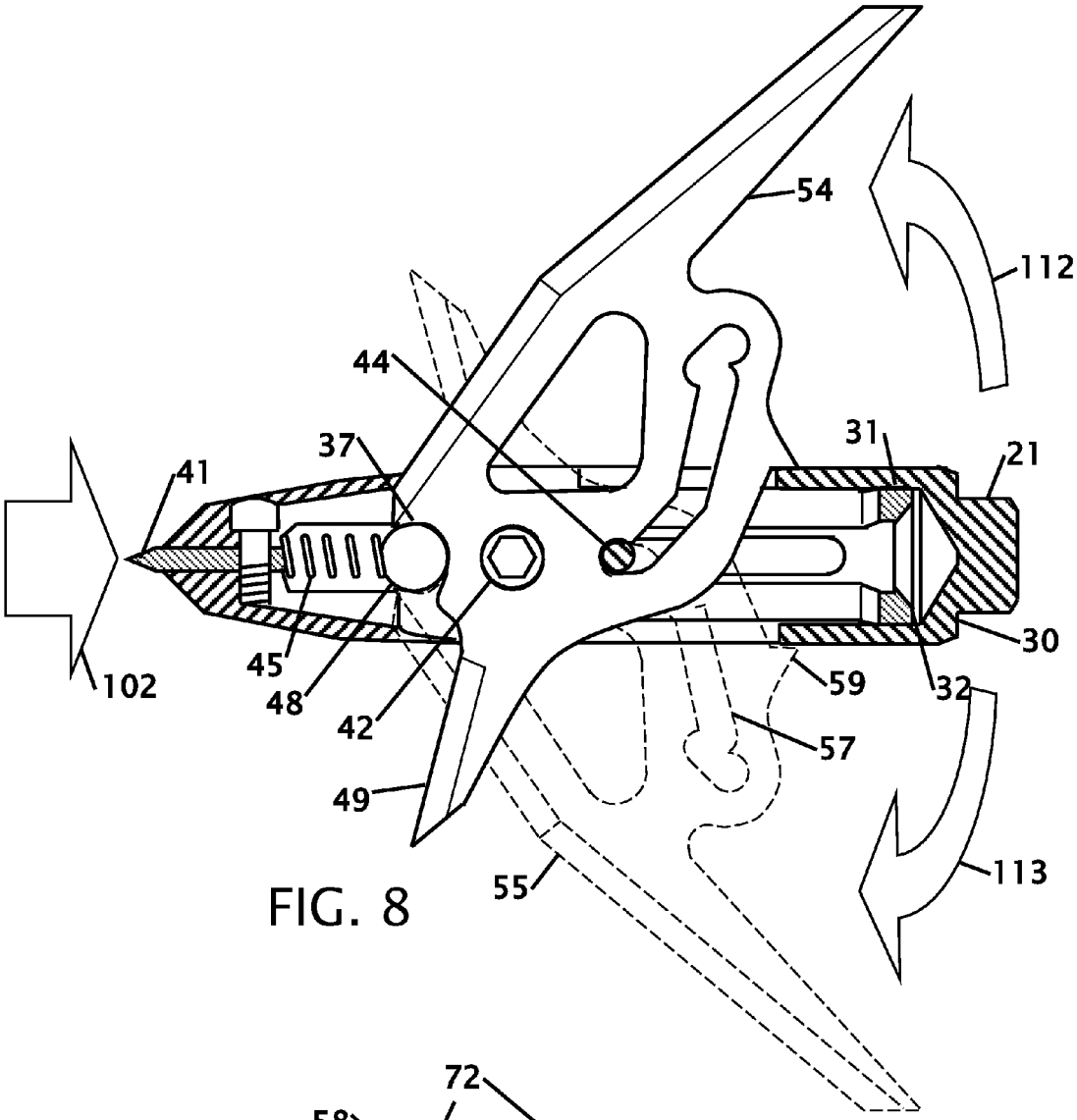
FIG. 8 shows a plan view of a second embodiment with counter blades in an open configuration.
Figure 9:
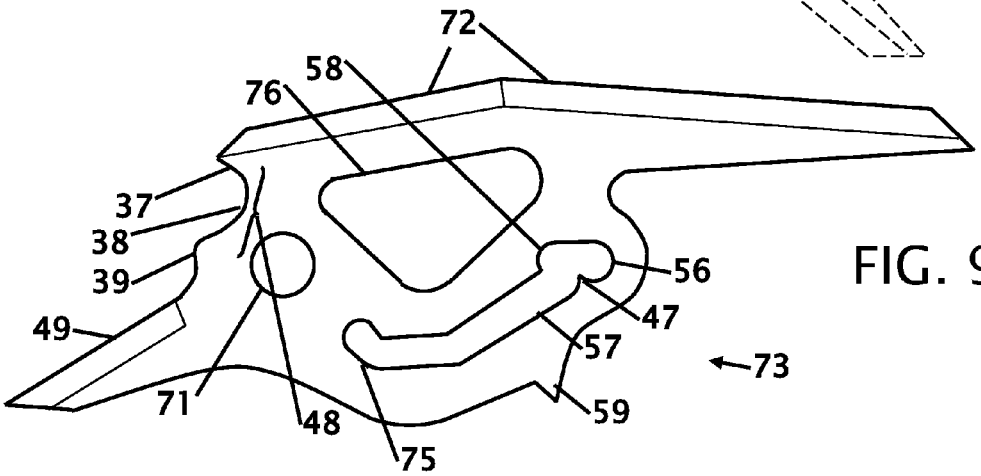
FIG. 9 shows a plan view of the second embodiment blade.

FIG. 8 shows a plan view of a second embodiment 72 with counter blades 49 in an open configuration, and FIG. 9 shows a plan view of the second embodiment blade. This embodiment is similar to the previous embodiment with the exception that this blade has a reverse cutting edge 49. The stop 37 of the ball guide has been enlarged to prevent over-travel of the blades because the stop(s) 37 is/are in contact with the ball 48 when the blades 73 are fully extended.

Figure 10:
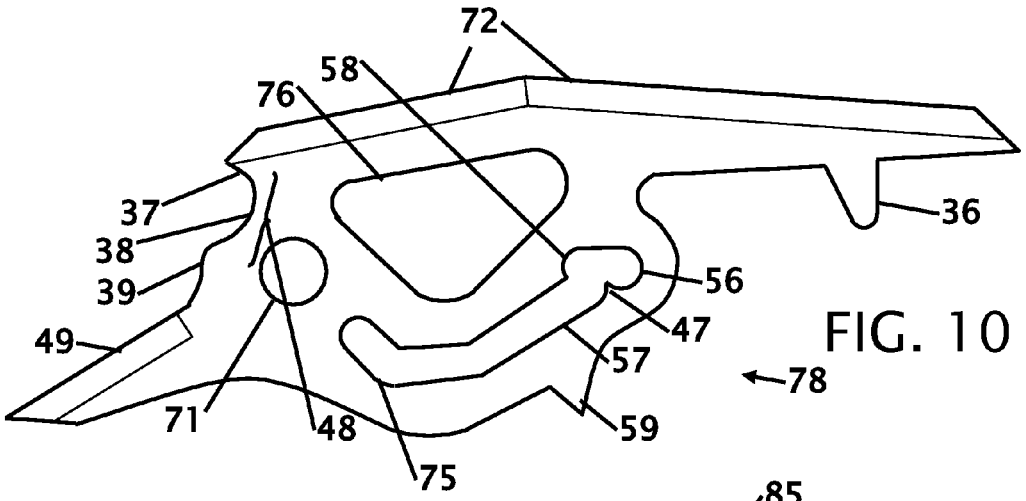
FIG. 10 shows a plan view of the third embodiment blade.
Figure 11:
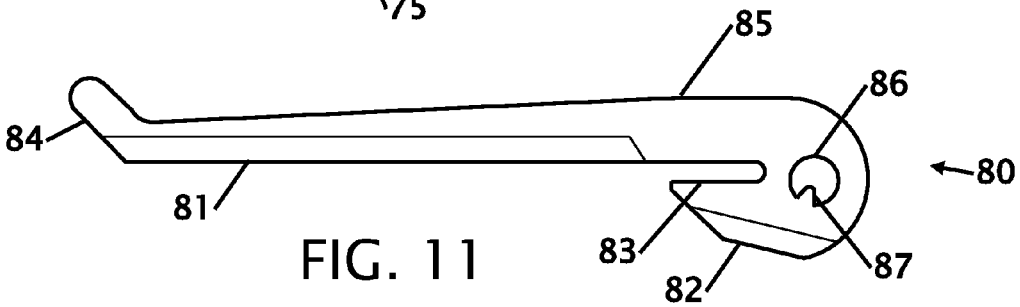
FIG. 11 shows a plan of a side blade used with the third embodiment.

FIG. 10 shows a plan view of the third embodiment blade 78 and FIG. 11 shows a plan of a side blade 80 used with the third embodiment. The third embodiment blade 78 is essentially similar to the second embodiment with the addition of a gate tab 36. The gate tab 36 fits into the slot 83 on the side blade 80. The side blade 80 has two cutting surfaces 81 and 82. When the gate tab 36 is lifted from the side blade 80, the side blade 80 is free to rotate on the central pivot hole 86. The pivot hole 86 has a tab 87 that prevents over-rotation of the side blade 80. In this figure, the side secondary blades show a round pivot hole 86 having a "flat" or tab 87 inside or inward facing detail that will limit against a "flat" on the end of a pivot pin that secures the side blade 80 to the body of the arrowhead. Upon penetration into an object ear 84 makes contact with the target. The ear 84 slides along the surface of the target and opens the side blade 80. The back 85 of the blade 81 is not sharpened, and wraps around the pivot hole 86.

Figure 12:
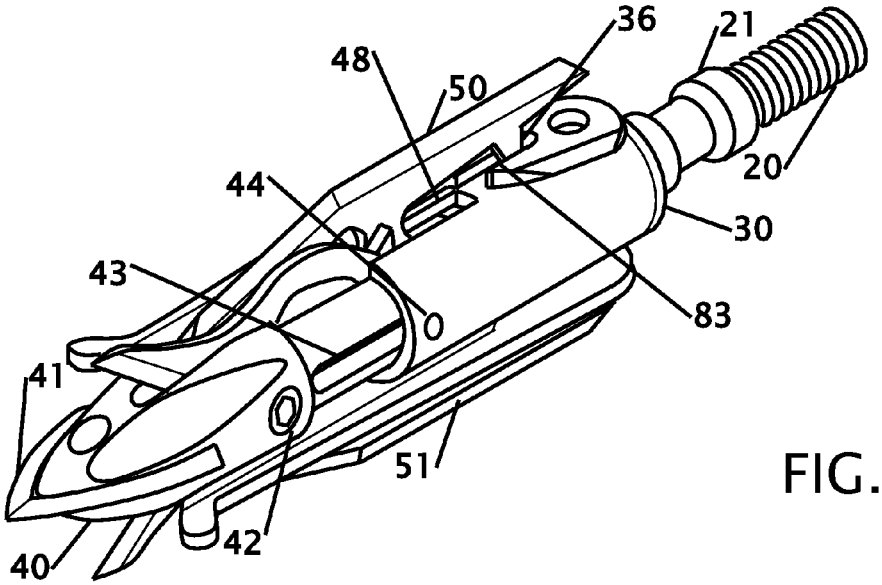
FIG. 12 shows a perspective view of the third embodiment.
Figure 13:
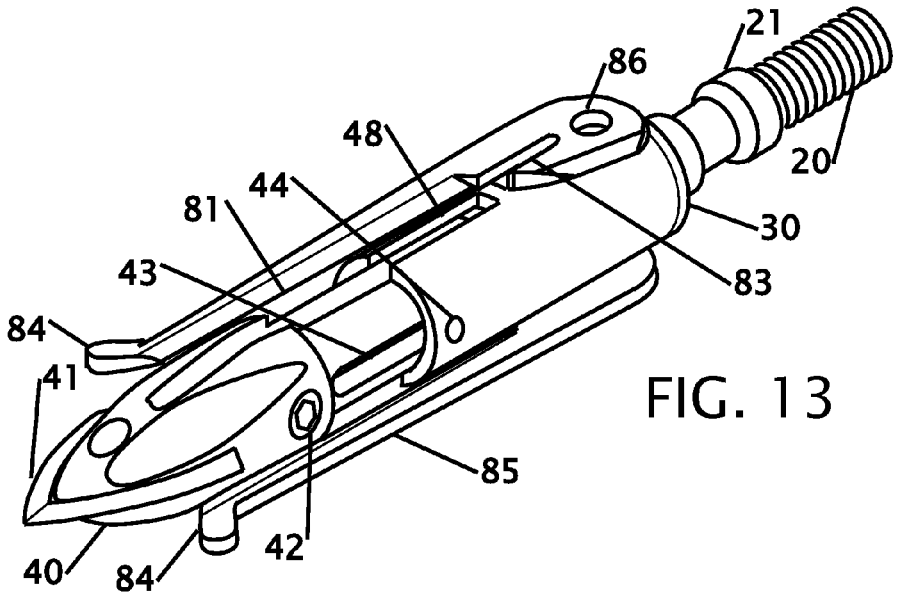
FIG. 13 shows a perspective view of the third embodiment with the main blades removed.

FIG. 12 shows a perspective view of the third embodiment, and FIG. 13 shows a perspective view of the third embodiment with the main blades removed. The arrowhead is shown with a threaded 20 shaft 21 for screwing into the shaft of an arrow 19. The blades 50 and 51 are initially retracted or placed into the housing body 30 to create a smaller profile to reduce air resistance and allow the arrow to travel with greater speed and accuracy. The blades 50 and 51 are initially retracted or placed into a 48 recess that is sized to accommodate the width of the blades when the pair of rear deploying blades is oriented toward opposite sides of the housing body 30. The tab or ear 36 is engaged into slot 83 that locks the side blade from rotating.

The body of the arrowhead has a front body section 40 with a tip blade 41. In the embodiment shown the tip is shown as a rounded tip with a point. It is also contemplated that the tip area 41 can be fitted with additional cutting surfaces. In the embodiment shown there are two expandable blades 50 and 51. Each blade 50 and 51 is connected to the head with a pivot axle 42 and a guide pin 44. The guide pin 44 is further located within a track 43 that provides linear motion of the guide pin 44 within the arrowhead. The blades 50 and 51 remain in the retracted orientation until the arrow is launched from a bow, compound bow, cross bow or other bolt launching apparatus.

Figure 14:
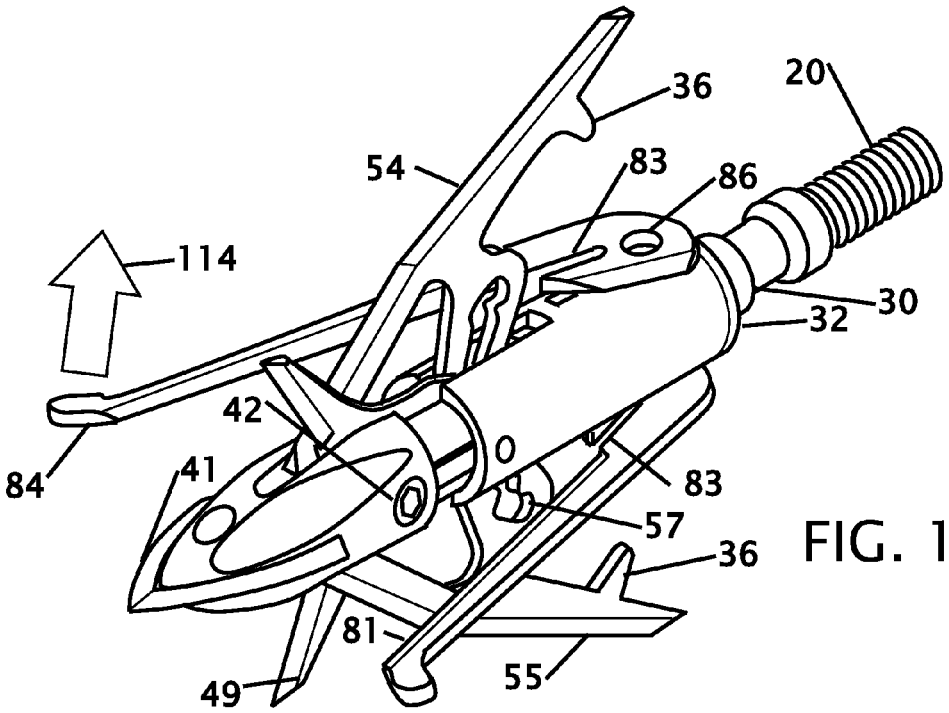
FIG. 14 shows a perspective view of the third embodiment in a partially opened configuration.
Figure 15:
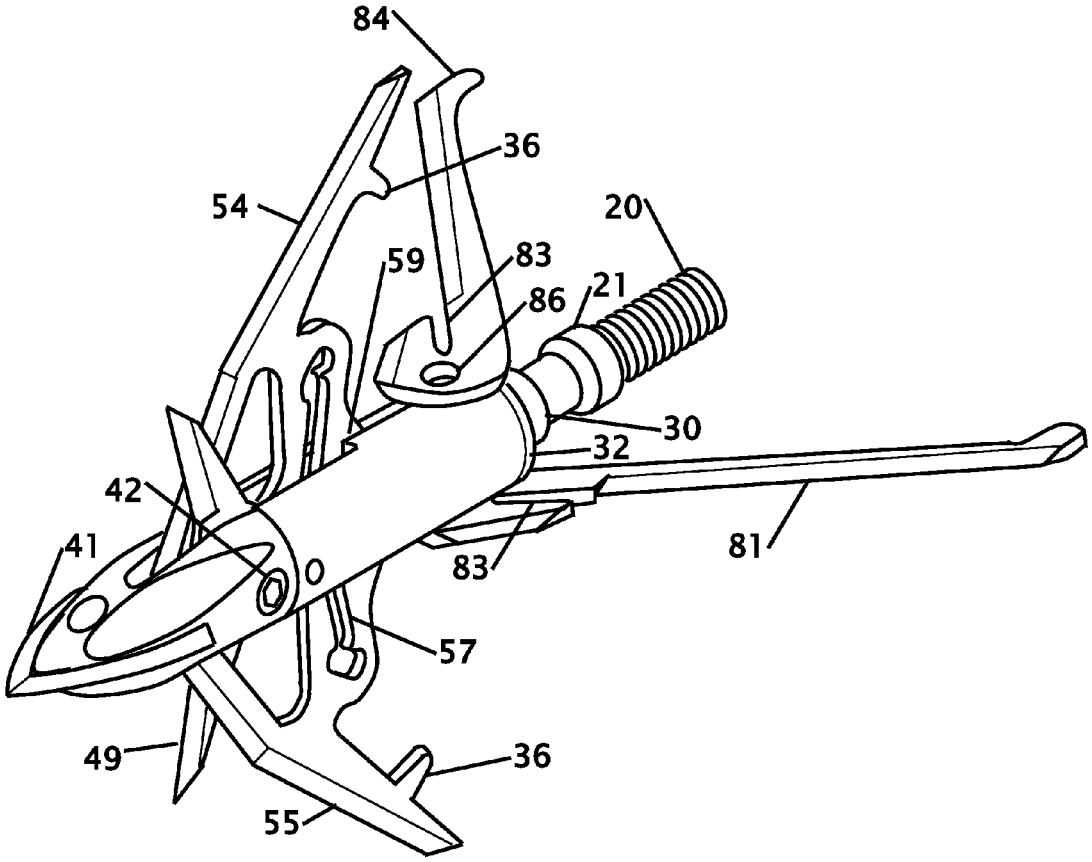
FIG. 15 shows a perspective view of the third embodiment in an opened configuration.

FIG. 14 shows a perspective view of the third embodiment in a partially opened configuration and FIG. 15 shows a perspective view of the third embodiment in an opened configuration. Once the gate tabs 36 are lifted from the slot(s) 83 in the side blades 80, contact with the ears 84 allow the side blades 80 to rotate 114 (shown in FIG. 14) and swing back to the rear position shown in FIG. 15 thereby providing 90 degrees of cutting surfaces.

Thus, specific embodiments of a broadhead arrowhead with two-stage expansion have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A broadhead arrowhead with two-stage expansion comprising:

a broadhead arrowhead body configured to be removably secured to an arrow shaft;

said broadhead arrowhead body having at least one pivoting axle;

said broadhead arrowhead body having at least one guide pin;

at least one blade pivotally engaged on said at least one pivoting axle and slidably engaged on said at least one guide pin;

said at least one blade has a closed configuration, and open configuration and at least one primed configuration that exists between said closed configuration and said open configuration;

wherein said at least one primed configuration is engaged when a first sufficient abrupt force is applied to an essentially concentric first end of said broadhead arrowhead body, and further includes at least one secondary side blade that operate with said at least one blade.

2. The broadhead arrowhead with two-stage expansion according to claim 1 wherein said at least one primed configuration is achieved with said arrow shaft is launched with said broadhead arrowhead secured thereof.

3. The broadhead arrowhead with two-stage expansion according to claim 2 wherein said open configuration is achieved when a tip of said broadhead arrowhead makes contact with a surface.

4. The broadhead arrowhead with two-stage expansion according to claim 1 wherein said two-stage expansion is with a "Z", "S" or "5" shaped guide track.

5. The broadhead arrowhead with two-stage expansion according to claim 4 wherein said "Z", "S" or "5" shaped guide track further includes at least one notch or recess that extends from said "Z", "S" or "5" shaped guide track.

6. The broadhead arrowhead with two-stage expansion according to claim 1 wherein that further includes at least one spring.

7. The broadhead arrowhead with two-stage expansion according to claim 6 wherein said spring maintains force between said at least one blade and said at least one guide pin.

8. The broadhead arrowhead with two-stage expansion according to claim 6 wherein said spring is a compression spring.

9. The broadhead arrowhead with two-stage expansion according to claim 1 wherein that further includes at least one linear guide.

10. The broadhead arrowhead with two-stage expansion according to claim 9 wherein said at least one linear guide is at least one piston.

11. The broadhead arrowhead with two-stage expansion according to claim 10 wherein said at least one piston travels within at least one cylinder.

12. The broadhead arrowhead with two-stage expansion according to claim 1 wherein said broadhead arrowhead body removable securing includes a threaded portion for removable securing to said arrow shaft.

13. The broadhead arrowhead with two-stage expansion according to claim 1 wherein said at least one blade is fabricated from a group comprising tool steel, M-2, S-7 & D-2, stainless steels, 301, 304, 410, 416, 420, 440A, 440B, 440C, 17-4 PH, 17-7 PH, 13C26, 19C27, G1N4, high speed steel, carbon steels, carbides, titanium alloys, tungsten alloys, tungsten carbides, powdered metal, ceramics, zirconia ceramics, organic polymers, plastics, glass, silicone containing compounds and composites.

14. The broadhead arrowhead with two-stage expansion according to claim 1 wherein said open configuration is engaged when a second sufficient force is applied to an opposing end of said broadhead arrowhead body where said opposing end is opposite of said first end of said broadhead arrowhead body.

15. The broadhead arrowhead with two-stage expansion according to claim 1 that further includes a tapered tip.

16. The broadhead arrowhead with two-stage expansion according to claim 1 that includes two blades wherein each of said two blade move in unison.

17. The broadhead arrowhead with two-stage expansion according to claim 1 wherein said at least one blade recess comprises a single blade recess having a width sized to receive a pair of blades oriented toward opposite sides of said broadhead arrowhead body.

18. The broadhead arrowhead with two-stage expansion according to claim 1 wherein said broadhead arrowhead body is fabricated from a group comprising of a metal, a polymeric material, a fiber reinforced polymer, ceramic and a molded metal injection molded composite.

19. The broadhead arrowhead with two-stage expansion according to claim 1 that does not rely upon an elastically deformable or plastically deformable retainer to retain said at least one blade in said closed or said primed configuration.

* * * * *